US007182851B2

(12) United States Patent
Gomez

(10) Patent No.: US 7,182,851 B2
(45) Date of Patent: Feb. 27, 2007

(54) ELECTROLYTIC COMMERCIAL PRODUCTION OF HYDROGEN FROM HYDROCARBON COMPOUNDS

(76) Inventor: Rodolfo Antonio M Gomez, 25 Olde Coach Road, Urrbrae, 5064, South Australia (AU)

( * ) Notice: Subject to any disclaimer, the term of this patent is extended or adjusted under 35 U.S.C. 154(b) by 577 days.

(21) Appl. No.: 10/432,711

(22) PCT Filed: Nov. 28, 2001

(86) PCT No.: PCT/AU01/01551

§ 371 (c)(1),
(2), (4) Date: May 27, 2003

(87) PCT Pub. No.: WO02/44081

PCT Pub. Date: Jun. 6, 2002

(65) Prior Publication Data

US 2005/0098443 A1 May 12, 2005

(30) Foreign Application Priority Data

| | | |
|---|---|---|
| Nov. 30, 2000 | (AU) | PR 1777 |
| Dec. 4, 2000 | (AU) | PR 1847 |
| Dec. 18, 2000 | (AU) | PR 2138 |
| Apr. 11, 2001 | (AU) | PR 4350 |

(51) Int. Cl.
*C25B 1/02* (2006.01)
*C25B 15/00* (2006.01)
*C25B 1/00* (2006.01)
*C25C 1/00* (2006.01)

(52) U.S. Cl. ..... 205/637; 205/349; 205/352; 205/615

(58) Field of Classification Search ..... 205/637, 205/349, 352, 615
See application file for complete search history.

(56) References Cited

U.S. PATENT DOCUMENTS

| | | | | |
|---|---|---|---|---|
| 4,226,683 | A * | 10/1980 | Vaseen | 205/555 |
| 4,268,363 | A * | 5/1981 | Coughlin | 205/367 |
| 4,608,137 | A * | 8/1986 | Vaughan et al. | 205/637 |
| 4,699,700 | A * | 10/1987 | Dhooge | 205/560 |
| 5,882,502 | A | 3/1999 | Gomez | 205/568 |
| 2003/0226763 | A1* | 12/2003 | Narayanan et al. | 205/637 |
| 2005/0126924 | A1* | 6/2005 | Gomez | 205/637 |

FOREIGN PATENT DOCUMENTS

WO WO 200017418 A1 * 3/2000

* cited by examiner

*Primary Examiner*—Edna Wong
(74) *Attorney, Agent, or Firm*—Klauber & Jackson

(57) ABSTRACT

This invention concerns the commercial production of electrolytic hydrogen from coal and other hydrocarbon compounds. The process provides high capacity and low impedance compared to conventional diaphragm electrolytic cells. The hydrogen produced is suitable for combined cycle gas turbines and fuel cell power generation plants and for proton electrolytic membrane fuel cell powered transport vehicles.

29 Claims, 9 Drawing Sheets

ELECTROLYTIC COMMERCIAL PRODUCTION OF HYDROGEN FROM HYDROCARBON COMPOUNDS

FIELD OF INVENTION

This invention concerns an electrolytic process for the commercial production of hydrogen from solid, liquid, or gas hydrocarbon compounds using a high capacity electrolytic cell as described in U.S. Pat. No. 5,882,502 Mar. 16, 1999 that functions without a diaphragm between the anode and the cathode. High capacity and low impedance of the electrolytic cell are necessary to achieve the high capacity required for the commercial production of hydrogen.

INTRODUCTION

Our way of life requires increasing energy in the form of electricity and transport energy. This must be achieved based on a reliable abundant energy source and with acceptable pollution of the environment, particularly the production of toxic and greenhouse gases.

Coal is the most abundant and widely spread energy source of the world with reserves estimated to last for several hundred years. Table 1 shows the major production of coal and the portion used in electricity generation. At the present, practically none is used for road transport energy.

TABLE 1

Major Hard Coal Producers and Portion Used in Electricity Generation (1999)

| Country | Annual Production, Million Tonnes | Used for Electricity Percent |
|---|---|---|
| PR of China | 1,029 | 80 |
| United States of America | 914 | 56 |
| India | 290 | 68 |
| South Africa | 224 | 90 |
| Poland | 112 | 96 |

Coal has been mainly used for power generation using the inefficient direct coal fired steam turbine power plants or the more efficient integrated gasification combined cycle gas turbine. Transport energy is provided mainly by liquid hydrocarbons using inefficient internal combustion engines. These energy systems are major causes of atmospheric pollution and there is the increasing problem of limited crude oil supply and increasing prices.

The use of coal efficiently to supply electrical energy and transport energy must be the centre piece of a total energy program for the coming decades. The process as described in this invention converts coal by electrolysis into carbon dioxide and hydrogen at a commercial ale. The hydrogen can be used to produce electrical power by fuel cells or by the combined cycle gas turbine. The hydrogen can also be used as fuel for fuel cell powered vehicles to replace liquid hydrocarbons such as gasoline and diesel fuel used for transport energy.

This invention applies to the conversion of solid, liquid, or gas hydrocarbon compounds to hydrogen but the emphasis in the discussions is coal electrolysis to produce hydrogen.

PRIOR ART

The electrolysis of coal has been reported since about the early nineteen thirties but further development was probably curtailed by the use of the diaphragm type electrolytic cell that has high impedance and low reaction rates. The diaphragm cell would have suffered further when coal particles and reaction by-products such as tar fouled up the diaphragm. A further handicap of the production of electrolytic hydrogen from coal is that one Faraday of electricity will produce only one gram of hydrogen. This makes it more important that a commercial process for the electrolytic conversion of carbon to hydrogen must be capable of high capacity.

A review of the electrolysis of coal is given by Su Moon Park in the "Electrochemistry of Carbonaceous Materials and Coal", Journal of Electrochemical society, 131, 363C, (1984). The following description has been obtained mostly from this publication and from a book, "Fuel Cells and their Applications" by Karl Kordesch and Gunther Simader, VCH, 1996.

The oxidation of coal to hydrogen has been reported on since about 1932, beginning with the chemical oxidation using aqueous alkaline solutions. Subsequently, the aqueous add electrochemical oxidation of coal was studied. Coughlin and Farouque published a series of papers on the anodic oxidation of coal with platinum anode in sulfuric acid. They concluded the following stoichiometry:

At the anode:

$$C+2H_2O \rightarrow CO_2+4H(+)+4e(-) \text{ or}$$

$$C+H_2O \rightarrow CO+2H(+)+2e(-)$$

At the cathode:

$$4H(+)+4e(-) \rightarrow 2H_2$$

Coughlin's standard potential for the reaction was 0.223V vs NHE. Measurement of the ratio of $H_2$ to $CO_2$ and CO was greater than stoichiometric indicating other reactions are occurring. Baldwin et al carried out detailed voltametric studies on oxidation of coal in acid media and non-aqueous solution and suggested that the Fe(2+) ion was responsible for most of the oxidation in coal. The iron was leached from the coal. Dhoogie et al resolved the matter by carrying out detailed studies on the mechanism of coal slurry oxidation. When coal was washed in a 1:1 sulfuric acid solution for more than 50 hours, practically no anodic current was observed. When Fe(3+) was added to the slurry and the anodic potential maintained such that Fe(2+) would be oxidised, the anodic currents were observed. Dhoogie suggested the following mechanism:

At the anode:

$$4Fe(3+)+Coal+2H_2O \rightarrow 4Fe(2+)+CO_2+4H(+)+\text{other products}$$

At the anode;

$$4Fe(2+)-4e(-) \rightarrow 4Fe(3+)$$

At the cathode:

$$4H(+)+4e(-) \rightarrow 2H_2$$

A rapid increase in reaction rate is noted for catalysts with redox potentials of 0.6 to 0.9 volts. This suggests that functional groups in the coal such as the quinone and hydroquinone are responding to the catalyst. Ce(4+) and Br(−) were the most effective electrocatalyst.

Summarizing, the fundamental mechanism of chemical coal oxidation and electrolytic oxidation is the same; surface oxides and humic acid appear to form first and eventually, smaller hydrocarbon molecules and $CO_2$ are formed as oxidation proceeds. The factors that would affect the electrolytic commercial production of hydrogen from coal are current density, the type of electrolyte and its concentration, slurry density, type of catalyst in the electrolyte, nature of the coal, reagent concentrations, size of coal particles, temperature, pressure, electrode surface material and surface structure, and cell impedance. The current density and the nature of the current application such as steady or pulsed, or a combination of both would be significant. The cell impedance should be as low as possible to reduce energy consumption.

Carbon is the major component of coal as shown by the analysis of a bituminous coal from Virginia on Table 2.

TABLE 2

Analysis of a Bituminous Coal from Virginia
Proximate Analysis

| Component | % by Weight | Component | % by Weight |
|---|---|---|---|
| Moisture | 2.90 | Carbon, C | 80.31 |
| Volatile Matter | 22.05 | Hydrogen, $H_2$ | 4.47 |
| Fixed Carbon | 68.50 | Sulfur, S | 1.54 |
| Ash | 6.55 | Oxygen, $O_2$ | 2.85 |
| Total | 100.00 | Nitrogen, $N_2$ | 1.38 |
| | | Moisture, $H_2O$ | 2.90 |
| | | Ash | 6.55 |
| | | Total | 100.00 |

Heating Value, Btu/Lb 14,100

As carbon is the major component of the coal by far, this thermal energy comparison will only use carbon for simplicity but it must be noted that Coughlin and Farouque detected higher ratio than stoichiometric of hydrogen to carbon oxides in the electrolysis of coal. Generally, the hydrogen in hydrocarbons would be converted to hydrogen ions at the anode cell and hydrogen gas at the cathode cell in this process.

The most appropriate analysis of the electrolysis of coal is to compare it to the alternative of burning the carbon in a boiler for conventional power generation.

The oxidation of carbon to carbon dioxide in a boiler will generate heat as follows:

$$C+O_2 \rightarrow CO_2 \quad Ho=-393.7\ KJ \tag{1}$$

The oxidation of the two moles of hydrogen will produce the following heat (2):

$$2H_2+O_2 \rightarrow 2H_2O \quad Ho=-572.0\ KJ \tag{2}$$

The heat used in the electrolysis of coal (3) must be subracted from (2).

$$C+2H_2O \rightarrow CO_2+2H_2 \quad Ho=178.3\ KJ \tag{3}$$

Kordesch and Simader (p. 323) state that the theorem voltage for reaction (3) is 0.21 volts but the actual voltage is between 0.7 and 0.9 volts. Based on reaction (3) requiring 4 Faradays and 1 watt-hour being equivalent to 3,600.7 joules, the actual energy required by (3) can be estimated and deducted from the heat of reaction (2) to obtain a comparison of the heat of reaction in burning carbon to carbon dioxide in a boiler and converting the carbon to hydrogen by electrolysis and oxidizing the hydrogen for power generation. This comparison is shown on Table 3 with the hydrogen being converted to electricity either by fuel cells (75% electrical efficiency) or by a combined cycle gas turbine (56.7% electrical efficiency).

TABLE 3

Thermal and Electrical Efficiency of Coal Electrolysis - Electric Power Generation These calculations give an indication of the Commercial Thermal and Electrical Efficiency of the coal electrolysis process.
Consider only carbon for simplicity during the electrolysis of coal.
Assumptions of the various efficiencies are listed below.

| | |
|---|---|
| The overall reaction of the electrolysis of coal is: $C + 2H_2O \rightarrow CO_2 + 2H_2$ | |
| Energy Output if carbon is burned in a boiler for power generation: $C + O_2 \rightarrow CO_2$ | Ho = 393.7 KJ/Mol. |
| Energy from $2H_2$ produced from the electrolysis of coal: $C + 2H_2O \rightarrow CO_2 + 2H2H_2 + O_2 \rightarrow 2H_2O$ | Ho = 572.0 KJ/Mol. |
| Energy used in electrolysis to produce $2H_2$: | |
| Current to produce $2H_2$ gram mols = 96,484 × 4 = | 385,936 coulombs = ampere seconds |
| Ampere-hours to produce $2H_2$ moles at Assumed Current Efficiency | 112.85 amp.-hours |
| Theoretical Voltage of Coal Electrolysis = | 0.21 volts |
| Current Efficiency in Coal Electrrolysis, % | 95.00 |
| Fuel Cell Electrical Efficiency, % | 75.00 |
| Gas Turbine Electrical Efficiency, % | 56.70 |
| Coal-Boiler-Turbine Electrical Efficiency for lignite, % | 28.00 |
| Coal-Boiler-Turbine Electrical Efficiency for black coal, % | 35.00 |
| 1 KJ = | 1000 joules |
| 1 watt-hour = | 3,600.70 joules |
| Theoretical conversion of heat of oxidation of hydrogen to water to electricity is 82.9%. | |

NOTE:
The net Electrical efficiency of the Fuel Cell and Gas Turbine is compared to Gross W-H of C to $CO_2$.

| Coal Electrolysis | | Gross Watt | Fuel Cell | W-H Input | W-H Feed to Electrical Plant Production | | Net W-H Production | | | | | Nett W-H for Coal for Boiler Turbine System | |
|---|---|---|---|---|---|---|---|---|---|---|---|---|---|
| | | | | | | | Fuel Cell Plant | | Gas Turbine Plant | | Gross W-H | | |
| Voltage Volts | Watt-Hours | Hours of 2H2 · 2H2O | W-H for Coat Elect. | into Coal Electrolysis | Fuel Cell | Gas Turb | Net W-H | Elect Eff, % | Net W-H | Elect Eff, % | C to CO2 | Lignite | Black Coal |
| 0.2100 | 23.70 | 158.86 | 31.60 | 133.04 | 127.26 | 127.26 | 95.45 | 87.29 | 72.16 | 65.99 | 109.34 | 30.62 | 38.27 |
| 0.2625 | 29.62 | 158.86 | 39.50 | 138.96 | 119.36 | 119.36 | 89.52 | 81.87 | 67.68 | 61.90 | 109.34 | 30.62 | 38.27 |
| 0.3150 | 35.55 | 158.86 | 47.40 | 144.89 | 111.46 | 111.46 | 83.60 | 76.46 | 63.20 | 57.80 | 109.34 | 30.62 | 38.27 |
| 0.3675 | 41.47 | 158.86 | 55.29 | 150.81 | 103.56 | 103.56 | 77.67 | 71.04 | 58.72 | 53.70 | 109.34 | 30.62 | 38.27 |
| 0.4200 | 47.40 | 158.80 | 63.19 | 156.74 | 95.66 | 95.66 | 71.75 | 65.62 | 54.24 | 49.61 | 109.34 | 30.62 | 38.27 |
| 0.4725 | 53.32 | 158.86 | 71.09 | 162.66 | 87.76 | 87.76 | 65.82 | 60.20 | 49.76 | 45.51 | 109.34 | 30.62 | 38.27 |
| 0.5250 | 59.24 | 158.86 | 78.99 | 168.58 | 79.87 | 79.87 | 59.90 | 54.78 | 45.28 | 41.42 | 109.34 | 30.62 | 38.27 |
| 0.5775 | 65.17 | 158.86 | 86.89 | 174.61 | 71.97 | 71.97 | 53.97 | 49.36 | 40.80 | 37.32 | 109.34 | 30.62 | 38.27 |
| 0.6300 | 71.09 | 158.86 | 94.79 | 180.43 | 64.07 | 64.07 | 48.05 | 43.95 | 36.33 | 33.22 | 109.34 | 30.62 | 38.27 |
| 0.6825 | 77.02 | 158.86 | 102.69 | 186.36 | 56.17 | 56.17 | 42.13 | 38.53 | 31.85 | 29.13 | 109.34 | 30.62 | 38.27 |
| 0.7350 | 82.94 | 158.86 | 110.59 | 192.28 | 48.27 | 48.27 | 36.20 | 33.11 | 27.37 | 25.03 | 109.34 | 30.62 | 38.27 |
| 0.7875 | 88.87 | 158.86 | 118.49 | 198.21 | 40.37 | 40.37 | 30.28 | 27.69 | 22.89 | 20.93 | 109.34 | 30.62 | 38.27 |
| 0.8400 | 94.79 | 158.86 | 126.39 | 204.13 | 32.47 | 32.47 | 24.35 | 22.27 | 18.41 | 16.64 | 109.34 | 30.62 | 38.27 |
| Column A | B | C | D | E | F | G | H | I | J | K | L | M | N |

Table 3 shows that the thermal efficiency of the coal to hydrogen process depends greatly on the voltage used for electrolysis. The voltage for electrolysis consists of the voltage for the reaction of 0.21 volts plus the over-voltage at the electrodes plus the resistance voltage of the electrolyte between the electrodes. There is another voltage that may be present based on observations in our experiments. As electrons are withdrawn from the anode electrolyte and impressed on the cathode electrolyte, the anolyte develops a positive charge while the catholyte develops a negative charge. Perhaps other researchers have combined this voltage as part of the electrode over-voltage but his may be dealt with separately. The electrode over-voltage can be reduced by using the appropriate material and surface structure of the electrode and high temperature and pressure. Resistance between electrodes can be reduced by using high temperature and pressure to improve conductivity and reduce the effect of gas bubbles in the electrolyte.

DESCRIPTION OF THE INVENTION

In one form therefore the invention is said to reside in n electrolytic process that converts solid, liquid, or gas hydrocarbon compounds and water to carbon dioxide and hydrogen at high reaction rates using an electrolytic cell that operates without a diaphragm at high pressure and moderate temperature using catalysts in an electrolyte, wherein the electrolytic cell consists of the anode cell containing an anode electrode connected to a DC power source and an anode solution electrode connected by an external conductor to a cathode solution electrode and a cathode cell containing a cathode electrode connected to the DC power source and the cathode solution electrode and an electrolyte containing the hydrocarbon compounds is reacted with water in the anode cell to produce carbon dioxide and hydrogen ions and the electrolyte containing the hydrogen ions is transferred to the cathode cell and hydrogen ions are reacted in the cathode cell to produce hydrogen.

In an alternative form the invention is said to reside in an electrolytic apparatus that converts solid, liquid, or gas hydrocarbon compounds and water to carbon dioxide and hydrogen at high reaction rates using an electrolytic cell that operates without a diaphragm at high pressure and moderate temperature using catalysts in the electrolyte, characterised by the electrolytic cell including an anode cell having an anode electrode connected to a DC power source and an anode solution electrode connected by an external conductor to a cathode solution electrode and a cathode cell containing a cathode electrode connected to the DC power source and the cathode solution electrode and the anode electrode and the cathode electrode have a shape and a surface structure designed to achieve intimate contact with the electrolyte and the ions contained in the electrolyte and material on the surface of the anode electrode and the cathode electrode offer low potential resistance or over-voltage, means to supply electrolyte and hydrocarbon compound to the anode cell and to transfer electrolyte from the anode cell to the cathode cell whereby electrolyte containing the hydrocarbon compound is reacted with water at the anode cell to produce carbon dioxide and hydrogen ions and the electrolyte containing the hydrogen ions is transferred to the cathode cell and hydrogen ions are reacted in the cathode cell to produce hydrogen.

Preferred embodiments of this invention are fully described in a technical description and a description of the commercial process to produce hydrogen from coal. The invention can be applied also to liquid hydrocarbon compounds in a similar fashion to coal electrolysis. For processing hydrocarbon liquids in a commercial process, it is necessary to break-up the hydrocarbon liquid into very fine particles by adding an emulsifying agent to the hydrocarbon and providing intense agitation with the electrolyte. For a gas such as methane, the anode reactions are:

$$CH_4-4e(-)\rightarrow C+4H(+) \quad (4)$$

$$C+2H_2O-4e(-)\rightarrow CO_2+4H(+) \quad (5)$$

At the cathode:

$$8H(+)+8e(-)\rightarrow 4H_2 \quad (6)$$

TECHNICAL DESCRIPTION

The technical basis of this invention is shown in FIG. 1. The electrolyte contains the fine coal particles in suspension and the catalyst ions such as ferrous ions. The ferrous ions are oxidised at the anode to ferric ions and the ferric ions in turn oxidise the coal particles and water in the electrolyte to carbon dioxide and hydrogen ions. The carbon dioxide is separated as a gas and the electrolyte containing the hydrogen ions is transferred to the cathode cell where the hydrogen ions are reduced to hydrogen gas by the electrons supplied by the DC power source to the cathode electrode. The hydrogen gas is removed from the electrolyte and the neutral electrolyte is returned to the anode cell where coal particles and water are added. The ionic circuit of the process is achieved by transferring the electrolyte containing the hydrogen ions from the anode to the cathode. The electronic circuit of the process is completed by the externally connected solution electrode where the electrons travel from the anode electrode to the DC power source to the cathode electrode through the catholyte to the cathode solution electrode to the external conductor connecting the solution electrodes to the anode solution electrode through the anolyte and to the anode electrode.

Using similar principles, the electrolysis of coal may also be carried out using compound electrodes in the anode and cathode cell. The compound electrodes and the process are shown on FIG. 2. The compound electrodes consist of an inner electrode and an outer electrode that acts as the anode or cathode electrode. The inner and outer electrodes are in electrical contact by means of a conducting liquid, or gel, or electrolytic membrane. The DC power source connects to the anode electrode and the cathode electrode while the inner electrodes are connected by an external conductor. The electrolyte contains the suspended fine coal particles, water, and the catalyst ions. The catalyst ions are oxidized at the anode electrode and in turn oxidize the coal particles to produce carbon dioxide and hydrogen ions. The carbon dioxide is separated from the electrolyte and the hydrogen ions are transferred to the cathode cell by transferring the electrolyte. At the cathode cell, the hydrogen ions are reduced at the cathode electrode to hydrogen gas. This hydrogen is separated before the electrolyte is recycled to the anode cell. The ionic and electronic circuits of the process are similar to the process shown on FIG. 1.

To minimize the over-voltage and impedance of the system, the anode and cathode cells may be operated at temperatures of up to 160 degrees Celsius and pressure of up to 50 bars. The anode and cathode electrodes may be shaped so that there is maximum intimate contact between the electrolyte and the anode and cathode electrodes. Expanded metal shapes with modifications are an example so that the electrolyte is in intimate contact with the electrodes. Surface coating of the anode and cathode solution electrode may also be selected to minimize over-voltage. The anode solution electrode and the cathode solution electrode may be modified so that these electrodes only act as current carriers. The active surfaces of the solution electrode can be covered by a non-conducting screen to minimize the contact of the ions in the electrolyte with the solution electrodes. A non-conducting screen may be a plastic screen with suitable design openings and thickness.

The electrolyte is preferably a mixture of water and acid such as sulfuric acid or phosphoric add containing multivalent catalyst ions such as iron, copper, cesium, vanadium or oxidising ions such as chlorine or bromine compounds. The electrolyte may also contain modifiers such as surfactants to allow greater wetting of the electrode surfaces and increased aerophobic properties of the electrode surface so that gas bubbles formed on the electrode surface particularly at the cathode do not interfere with the electrolytic reaction.

The technical process is simple but additional features may be incorporated to make the process commercially viable particularly in terms of the capacity, impedance, and efficiency of the commercial process.

Commercial Process

Concentric cylindrical cells where the anode or cathode is the outer cylinder and the solution electrode is the inner cylinder may be used for small plants up to 5 kilowatt capacity, however, cubical cells with a centre circulating well fitted with an impeller for agitation are preferred for large capacity electrolytic cells as shown on FIG. 3. One set of electrodes on either side of the circulating well is installed. At the anode cell, the electrodes will alternate between solution electrode and anode electrodes. Similarly, solution electrodes and cathode electrodes alternate at the cathode cell. The circulating slurry and the action of the impeller maintain the coal particles in suspension, provide good mixing of the electrolyte at the electrode surface to minimize over-voltage, and provide good contact between the catalyst ions in the electrolyte and the coal particles.

The electrolyte may be alkaline or acidic but the preferred electrolyte is mixtures of sulfuric acid or phosphoric acid and water. Laboratory tests have shown that the conductivity of the electrolyte increases with temperature up to the boiling point of the electrolyte. The electrolyte temperature may be maintained at up to 160 degrees Celsius and the pressure may be maintained at up to 50 bars pressure. These conditions will reduce the electrode over-voltage substantially and the impedance of the electrolyte between electrodes including the effect of the gas bubbles on impedance. Modifying agents such as surfactants may also be added to the electrolyte to improve wetting of the surface of the electrodes. At the cathode electrode, modifying agents will make the surface of the electrode aerophobic to separate gas bubbles from the electrode surface faster to allow the maximum area of the cathode electrode available for reaction. Modifiers in the electrolyte may also play a reducing role at the cathode cell similar to their oxidising role at the anode cell.

The anode electrode may be made of expanded sheet of titanium coated with platinum-rhodium-iridium oxides. There may be a variety of electrode configuration to provide large areas for contact between the anode electrode and the electrolyte. This electrode construction is relatively expensive and other cheaper electrode material are possible. The anode solution electrode may be made of the same material but other materials such as antimonial lead would be sufficient. The anode solution electrode may also be shielded by a plastic screen to prevent direct contact of the catalyst ions with anode solution electrode to ensure that the anode solution electrode functions only as an electron conductor.

The pressure is reduced after the anode cell to release the carbon dioxide gas and to separate both un-reacted coal particles and insoluble material form the electrolyte. Unreacted coal may be recovered by flotation or gravity separation and is recycled to the anode cell. Insoluble material is discarded to the waste pond. Further steps such as wet cycloning, liquid vortex separation or applying vacuum may be used to remove any carbon dioxide in the electrolyte. The clear electrolyte containing the hydrogen ions is fed under pressure to the cathode cell. Temperature is at up to 160 degrees Celsius while the pressure is at up to 50 bars. The hydrogen ions are reduced to hydrogen gas at the cathode electrode.

The pressure of the catholyte is reduced to allow the hydrogen gas to separate from the electrolyte. The hydrogen gas is cooled and dried before dispatch to storage while the catholyte is returned to the anode cell feed system where fine coal, reagent make-up and water are added.

A bleed solution may be taken to remove impurities that tend to build up in the electrolyte. Simple methods such as evaporation and cooling may be the most effective and low cost methods. Purified electrolyte is returned to the main circuit.

A similar process applies when compound electrodes are used in the anode and cathode cells instead of the solution electrodes.

An alternate method of carrying out the process is to oxdize the electrolyte only and this is mixed with the coal in a separate leaching or reaction vessel where the oxidation of the coal is carried out as shown on FIG. 4. The coal may be in a fixed bed or as an agitated slurry of fine coal. After liquid-solid-gas separation the clear anolyte is passed to the cathode cell where the hydrogen ion is reduced to hydrogen gas. This may offer benefits such as lower pressure in the anode cells resulting in savings on capital cost.

There may be provided microwave energy into the separate leaching or reaction vessel to assist with the reactions in the separate leaching or reaction vessel. The purpose of this addition to the process is to ensure a fast reaction rate during leaching and assurance that the catalyst ions in the electrolyte are used up in the coal leaching step to prevent the consumption of electrons by the catalyst ions at the cathode as this would lead to lower electrical efficiency of the process. The microwave energy may be applied at 800 to 22,000 megahertz and it may be applied at a steady state or the microwave energy may be pulsed into the coal slurry.

This process may also be applied to the treatment of coal, oil, tar sands, or oil shale that are too deep or too costly to extract by conventional mining. This method of extraction is often called solution mining and quite often possible because of the favorable geological structure that usually confines coal and oil deposits within competent structures allowing good recovery of the electrolyte. This method is shown on FIG. 5. Although this method may not be as efficient and be of less capacity than processing the coal at a surface plant, it is more friendly to the environment and may offer very competitive cost for this source of energy.

A simple diagram of the application of the process of this invention in power generation is shown on FIG. 6 with the efficiencies based on the oxidation of carbon. The power balance in FIG. 6 should be read in conjunction with Table 3. The waste heat from the fuel cell (or gas turbine) is not included in the power balance. In the actual plants, the utilization of the waste heat would improve the thermal efficiency of the system. Part of the hydrogen produced from the coal electrolysis is used to generate the low voltage DC power required for the coal electrolysis using fuel cells. This is probably more efficient than stepping down the voltage of part of the electricity produced in the main generator for use in the coal electrolysis. The power balance in FIG. 6 is based on a coal electrolysis voltage of 0.42 volts achieving an over-all electrical efficiency (based on carbon) of 65.62 percent for a fuel cell power generator and 49.6 percent for a gas turbine. Electrical efficiencies at different coal electrolysis voltage are given in Table 3.

The competing fossil fuels in power generation are coal and natural gas. Brown coal as mined has a heating value of 10 gigajoules per tonne and has a cost currently of about US$2.50 per tonne at minesite. This gives a comparative cost of US$ 0.25 per gigajoule. For bituminous coal, the heat content is about 32 gigajoules per tonne and a price of about US$17 per tonne at mine site. This gives a comparative cost of US$0.53 per gigajoule. The price of natural gas is about US$2.00 per gigajoule at source. This is a general comparison as the accurate comparison is to cost fuels at the power generation site. The general comparison shows that the coal fuel have a substantial price advantage. This price advantage is reduced when the cost of the coal electrolytic process to convert the coal to hydrogen is considered. The comparative fuel cost, based on actual 56.7 electrical efficiency for natural gas in a combined cycle gas turbine and 0.42 volts for coal electrolysis are:

Natural Gas with Combined Cycle Gas Turbine:

$$\text{Fuel Cost per Gigajoule} = \frac{\$2.00}{0.567} = \text{US } \$3.53$$

Brown Coal with Combined Cycle Gas Turbine:

$$\text{Fuel Cost per Gigajoule} = \frac{\$0.25}{0.4961} = \text{US } \$0.50$$

Black Coal with Combined Cycle Gas Turbine:

$$\text{Fuel Cost per Gigajoule} = \frac{\$0.53}{0.4961} = \text{US } \$1.07$$

Table 4 provides projections of the cell sizes for commercial coal to hydrogen fuel cell power units. Table 4 is based on a coal electrolysis voltage of 0.42 volts, current density of 3,000 amperes per square meter of active electrode surface, and cubicle cell with center circulating well so that the total number of electrodes is double the number shown on Table 4. The fuel cell electrical efficiency is assumed at 75 percent. FIG. 7 is a diagram of a 50,000 kilowatt coal electrolytic plant. It consists of 3 cells with each cell containing 242 anodes on each side of the center circulating well with each electrode measuring 2.5 meters×35 meters active surface. The cell trains measure about 13.5 meters×90 meters. Two of these cell trains will produce enough hydrogen for a 100,000 kilowatt power plant. On the other end of the capacity scale, a 5 kilowatt unit that is suitable to provide power for a house in a developed country such as the USA will require 4 electrodes on each side measuring 0.25 meters×0.64 meters. Cylindrical cells with tangential entry and exit of the feed stream where the outer electrode is the anode or cathode and a concentric inner cylinder is the solution electrode, may be used in small capacity applications. Turbulence is achieved without the use of impellers and baffles. A 2.0 meters high by 20.4 centimeters diameter cylindrical cell is equivalent to the 0.25 meters×0.64 meters by 4 electrodes cubicle cell. The projected dimensions of these commercial units will change depending on the optimum current density and coal electrolysis voltage determined in pilot plant testing for the coal fuel used. Each coal will have optimum characteristics of operation including the processing of impurities.

TABLE 4

Projections of Cell Sizes for Commercial Size Coal to Hydrogen-Fuel Cell Power Plants Calculations are based on Cubical Circulating Coal Slurry at the Anode Cells as shown on FIG. 8.
Electrodes are plate type with alternate Anode Electrodes and Solution Electrodes; size from .25 × .64 metres.

| | | |
|---|---|---|
| Area of Each Cell ($m^2$) = | 300 | Electrodes have 2 surfaces and there are 25 electrodes each side of the circulating center well. |
| Fuel Cell Electrical Efficiency, % | 75 | Theoretical Fuel cell Electrical Efficiency is 82.9%. |
| One gram-mole of hydrogen = joules | 143000 | in the reaction $\frac{1}{2}H_2 + \frac{1}{2}O \rightarrow \frac{1}{2}H_2O$(liquid) |
| One gram-mole of hydrogen = joules | 242000 | in the reaction $H_2 + \frac{1}{2}O_2 \rightarrow H_2O$(gas) |
| On gram mole of hydrogen = KWH | 0.03971 | in the reaction $\frac{1}{2}H_2 + \frac{1}{2}O \rightarrow \frac{1}{2}H_2O$ |
| One Gram Mole of Hydrogen Requires | 96,485 | Coulombs |
| One watt-hour = Joules | 3601 | |
| One Std Cubic meter of Hydrogen = moles | 44.64 | |
| One gram mole of hydrogen, liters | 22.4 | |
| Cell Voltage for Coal Electrolysis, volts | 0.420 | |
| Coal Electrolysis Current Efficienty, % | 95 | |

| Plant Size | Current per Cell | No. of Cells | Total Current |
|---|---|---|---|
| 5 KW | 7296 | 1 | 7296 |
| 100 KW | 149625 | 1 | 149625 |
| 1 MW | 1466325 | 1 | 1466325 |
| 10 MW | 7241850 | 2 | 14483700 |
| 100 MW | 24139500 | 6 | 144837000 |

TABLE 4-continued

Projections of Cell Sizes for Commercial Size Coal to Hydrogen-Fuel Cell Power Plants

| Coal Electrolytic Cell Dimensions | | | | | Coal | Coal Elec. | Coal | Coal Elec |
|---|---|---|---|---|---|---|---|---|
| Electrode Width meters | Electrode Height meters | Elect. Number of Electrodes in a Cell | Nominal Length of Cell meters | Coal Cell Electrode Area, m2 | Electrolysis Current Density Amp/m2 | Effective Current Prod. per Cell Amperes | Electro Power per Cell KW | Power Required per Day KWH |
| 0.25 | 0.64 | 4.0 | 0.6 | 3 | 3000 | 7296 | 3 | 74 |
| 0.75 | 1.25 | 14 | 1.8 | 53 | 3000 | 149625 | 63 | 1508 |
| 0.70 | 1.00 | 10.0 | 1.32 | 28 | 3000 | 79800 | 34 | 804 |
| 1.50 | 1.75 | 49.0 | 6 | 515 | 3000 | 1466325 | 816 | 14781 |
| 1.50 | 2.75 | 154.0 | 18.6 | 2541 | 3000 | 7241850 | 3042 | 72998 |
| 2.00 | 3.00 | 264.0 | 31.8 | 6336 | 3000 | 18057600 | 7584 | 182021 |
| 2.50 | 3.50 | 242.0 | 29.16 | 8470 | 3000 | 24139500 | 10139 | 243328 |
| 3.00 | 4.00 | 242.0 | 29.16 | 11816 | 3000 | 33105600 | 13904 | 333704 |
| 3.50 | 5.00 | 242.0 | 29.16 | 16940 | 3000 | 48279000 | 20277 | 486652 |

| Coal Elect. Hydrogen Produced per Day/cell gram Mols | Fuel Cell Electricity Produced per Day KWH | Gross KW Output per Cell KW | Net. KW Output per Cell KW | Total Electrical Efficiency % | Number of Cells Req'd 100 MW | Number of Cells Req'd 10 MW | No. of Cells Req'd 1 MW | No. of Cells Req'd 100 KW | No. of Cells Req'd 5 KW |
|---|---|---|---|---|---|---|---|---|---|
| 6533 | 195 | 8 | 5.04 | 62.21 | | | | | 1.0 |
| 133986 | 3991 | 166 | 103 | 62.21 | | | | 1.0 | |
| 71459 | 2128 | 89 | 55 | 62.21 | 1813 | 181.26 | 18.1 | 16.1 | 0.6 |
| 1313059 | 39111 | 1630 | 1014 | 62.21 | 99 | 9.86 | 1.0 | 16.1 | 10.1 |
| 6484903 | 193159 | 8048 | 5007 | 62.21 | | 2.00 | | | |
| 16170147 | 481642 | 20088 | 12484 | 62.21 | 8.01 | 0.80 | 0.1 | 16.1 | 124.8 |
| 21616342 | 643882 | 25828 | 16689 | 62.21 | 6 | | | | |
| 29645270 | 883010 | 36792 | 22888 | 62.21 | 4 | 0.44 | | | |
| 43232685 | 1287723 | 53655 | 33378 | 62.21 | 3 | 0.30 | | | |

A diagram of a large commercial plant for the electrolysis of coal is shown in FIG. 8. Fine fresh coal, reclaimed coal, water, reagents, and recycled electrolyte are mixed and preheated and then fed to each anode cell tank. There is always excess of coal to ensure maximum output from each anode cell. In this design, carbon dioxide is expelled from the anode cells. The reacted electrolyte and products is processed in a series of hydro-cyclones or liquid vortex separators to separate the solids and dissolved carbon dioxide from the electrolyte. Liquid vortex separators are separating devices where an impeller inside a cylinder creates a vortex of the liquid or slurry fed into the cylinder. The vortex separates the constituents of the slurry or liquid so that the lighter fraction such as gas will concentrate at the center of the cylinder and the heavy solids will concentrate towards the outer part of the cylinder. The fractions are separated at the conical end of the vortex separator. The liquid is then transferred to the cathode cells while the solids are taken to the coal separation plant where unreacted coal is separated by froth flotation or gravity separation. Hydrogen gas is evolved at the cathode and in this design, the hydrogen is taken off the cathode cells. The liquid is passed through liquid vortex separators to remove more hydrogen dissolved in the liquid before the liquid is returned to the feed mixer. Impurities in the coal will tend to build up in the electrolyte and a bleed stream is withdrawn continuously to remove the impurities and control their concentration in the electrolyte. Generally, the simplest method to remove impurities is to evaporate and cool the bleed solution. Metallurgical processes can be used to recover any valuable impurity in the bleed electrolyte such as nickel.

A more detailed flow diagram of a large commercial coal electrolytic plant is shown on FIG. 9. This includes the preparation of the coal and the coal electrolytic plant. A detailed description is given below in the Description of the Drawings.

Figure 1:
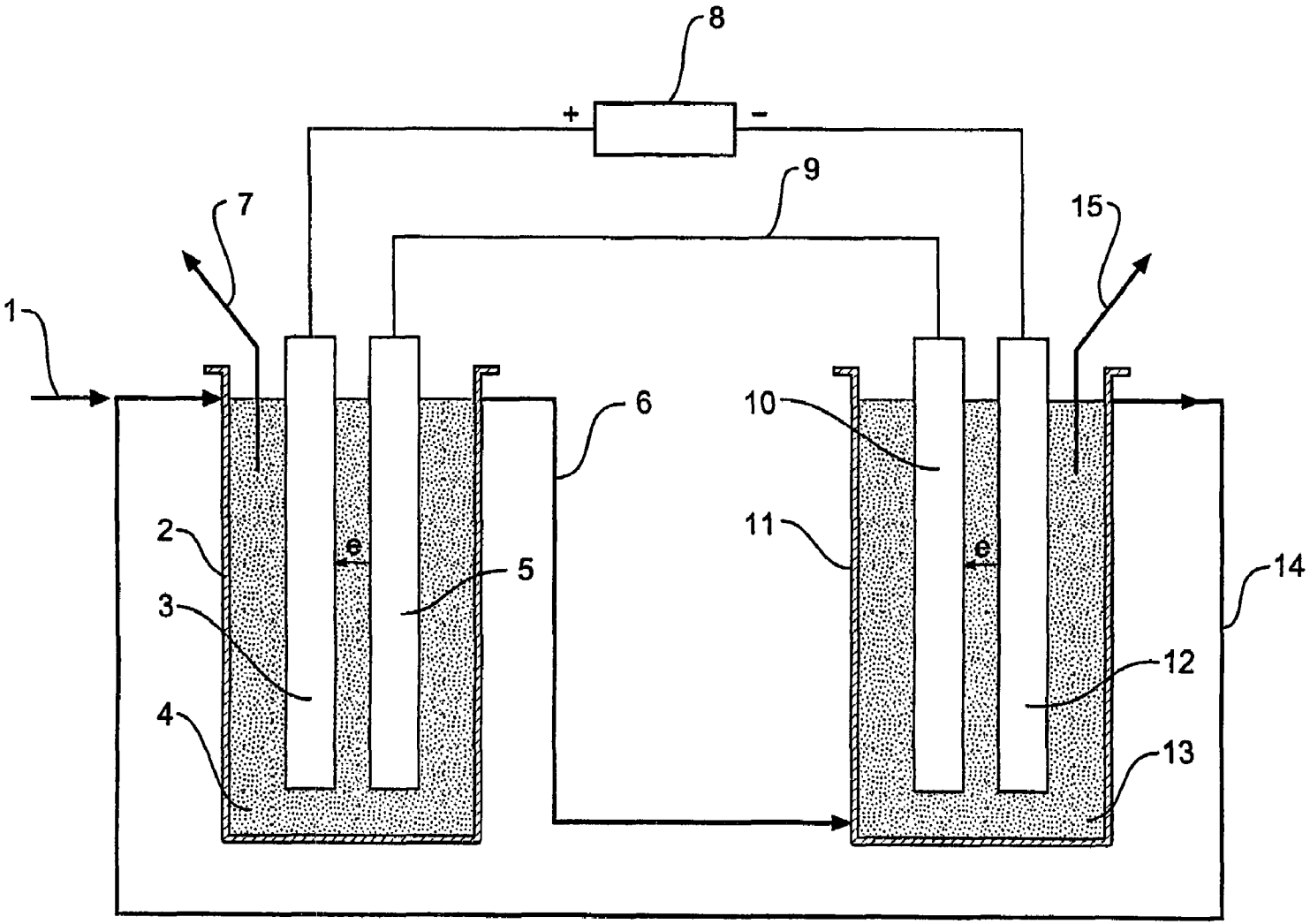
FIG. 1 shows the principle of the electrolytic cell in coal electrolysis according to the present invention.

Detailed discussion of selected drawings are given as follows:

FIG. 1 shows the principle of the use of an electrolytic cell in coal electrolysis of the present invention.

Fine coal and water 1 are continuously fed into the anode cell 2 where the anode electrode 3 remove electrons from the catalyst in the electrolyte. Carbon is oxidized to carbon dioxide with hydrogen ions produced. Hydrogen in the coal is also converted to hydrogen ions. Carbon dioxide 7 exits the anode cell. The anode electrode 3 is connected to the positive of the DC power source 8 while the anode solution electrode 5 is adjacent to the anode electrode and is externally connected by conductor 9 to the cathode solution electrode 10 adjacent to the cathode electrode 12.

The anolyte 6 containing the hydrogen ions is continuously transferred to the cathode cell 11 where the cathode electrode 12 connected to the negative of the DC power source 8 transfers electrons to the hydrogen ions producing hydrogen gas 15 that is evolved from the cathode cell. Reduction reaction in the cathode cell may also be carried out through the use of a catalyst in the catholyte. The reacted catholyte 14 containing catalysts is recycled to the anode cell 2. The electronic circuit of the process starts from the DC power source 8 where electrons are delivered to the cathode electrode 12 then travel through the catholyte 13 to the solution electrode 10 through the external conductor 9 to the anode solution electrode 5 through the anolyte 4 to the anode electrode 3 and then to the DC power source 8. The ionic circuit is achieved by transferring the anolyte 4 to the cathode cell 11.

Figure 2:
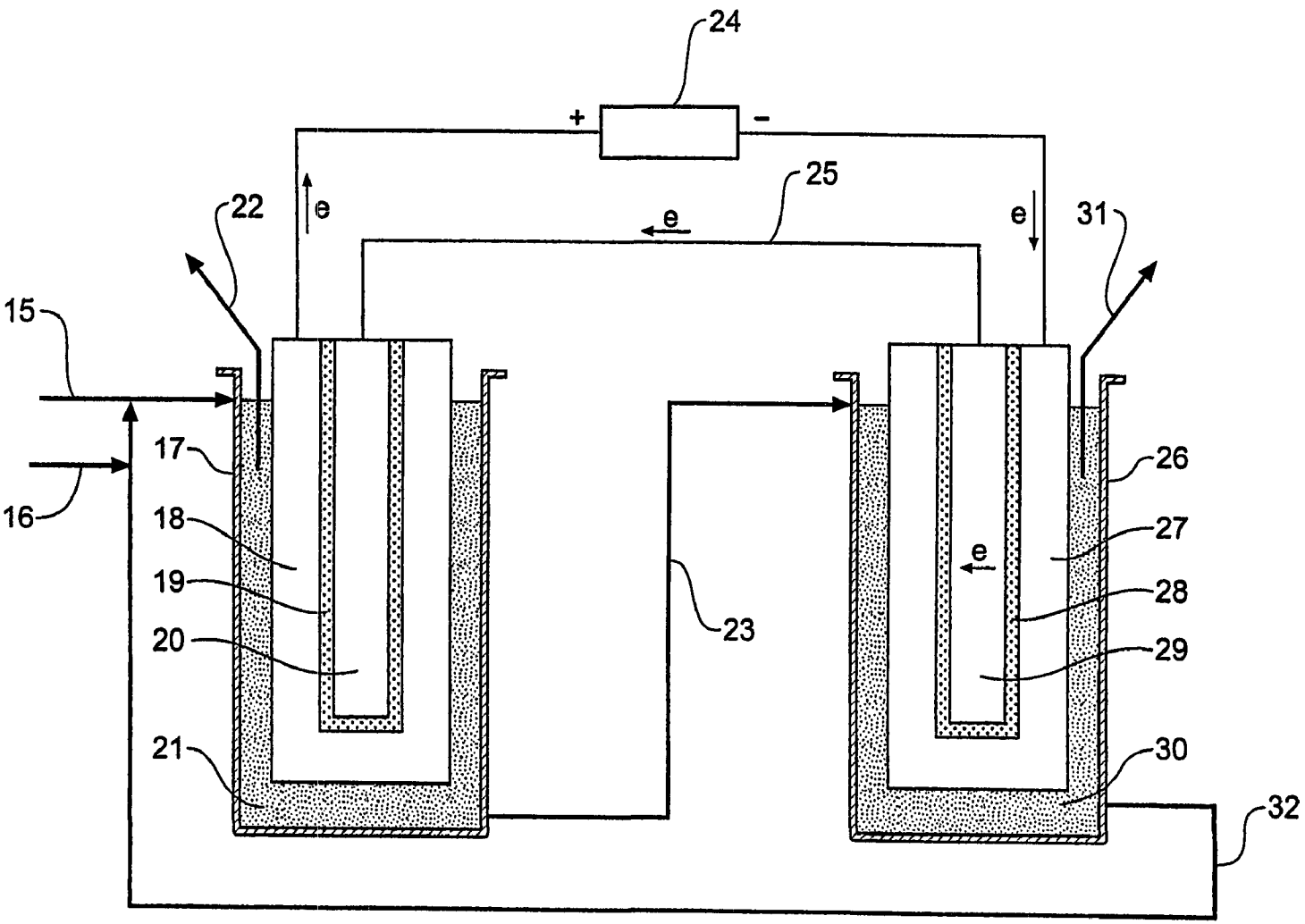
FIG. 2 shows coal electrolysis using the compound electrodes according to the present invention.

FIG. 2 shows the principle of the use of an electrolytic cell in coal electrolysis of the present invention using compound electrodes.

Fine coal and water 15, reagents 16 including catalysts, and recycled catholyte 32 are mixed and fed to the anode cell 17 containing the compound electrode consisting of an outer anode electrode 18, a liquid electrolyte or gel or electrolytic membrane 19 and an inner electrode 20. Oxidation of the carbon to carbon dioxide is effected by the anode electrode connected to the positive of the DC power source 24 and the catalyst in the anolyte 21. Hydrogen in the coal is converted to hydrogen ions. Carbon dioxide 22 is evolved from the anolyte while the hydrogen ions 23 are transferred to the cathode cell 26 that contains the cathode compound electrode consisting of an outer cathode electrode 27, a liquid electrolyte or gel or electrolytic membrane 28 and an inner electrode 29. Electrons from the cathode electrode 27 connected to the negative of the DC power source 24 reduce the hydrogen ions to hydrogen gas 31 that is evolved from the catholyte 30. Reduction of the hydrogen may also be carried out through catalysts in the catholyte. The reacted catholyte 32 is recycled to the anode cell 17. The electronic circuit of the process start at the negative of the DC power source. 24 where electrons are transferred to the cathode electrode 27 and then travel through the liquid electrolyte 28 to the cathode inner electrode 29 then through the external conductor 25 to the anode inner electrode 20 through the liquid electrolyte 19 to the outer anode electrode 18 and then to the positive of the DC power source 24.

Figure 3:
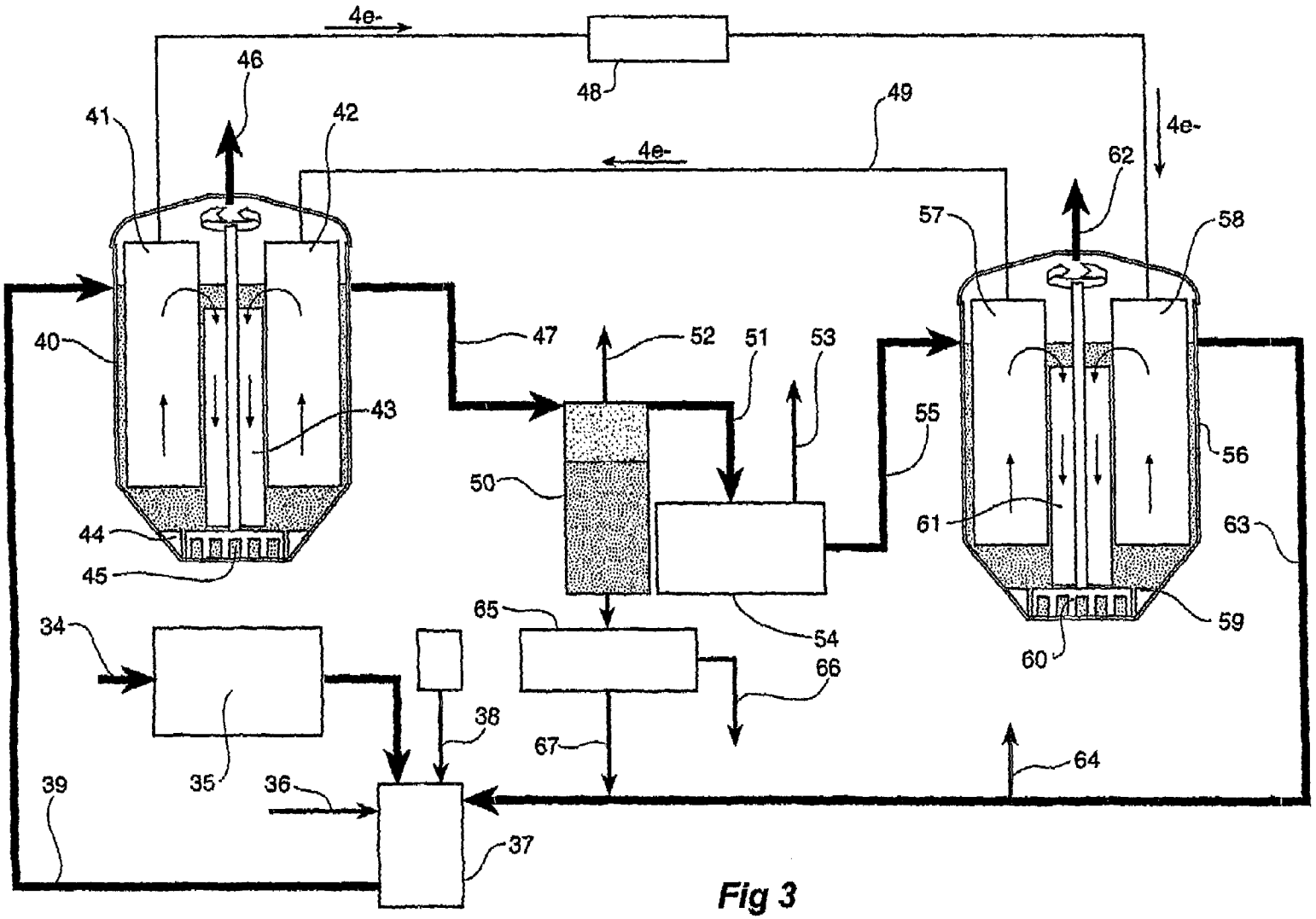
FIG. 3 shows circulating slurry at the anode cells using cubical cell tanks according to the present invention.

FIG. 3 shows an alternative embodiment for the production of hydrogen from coal with a circulating slurry anode.

This description is based on the use of solution electrodes as in FIG. 1 but applies also to the use of compound electrodes described in FIG. 2. Coal and water 34 is subjected to a pretreatment 35 that may include size reduction and removal of impurities such as sodium and chlorine and insoluble matter before the fine coal is delivered to the mixer 37 where water 36, reagent makeup 38 and recycled catholyte 63 are added. The resulting feed slurry 39 is fed to the anode cell 40 containing the anode electrode 41 and anode solution electrode 42. The anode cell contains a central circulating well 43, an impeller 45 acting against baffles 44 to provide agitation for the anolyte and coal slurry. Carbon in the coal is oxidized to carbon dioxide by the action of the anode electrode 41 and catalysts and the carbon dioxide 46 is evolved from the anode cell. Hydrogen in the coal is converted to hydrogen ions. The anode electrode 41 is connected to the positive of the DC power source 48 while the anode solution electrode 42 is connected to the cathode solution electrode 57 by external conductor 49. The oxidized slurry 47 is transferred to the gas-liquid-solid separator 50 where some more carbon dioxide 52 is removed and the solids separated from the electrolyte. The electrolyte 51 may further be subjected to vacuum or another process to remove more carbon dioxide 53. The slurry is processed in a separator 65 to recover unreacted coal 67 to be recycled to the mixer 37 and insoluble matter to be discarded to waste. The carbon dioxide free anolyte 55 containing hydrogen ions is transferred to the cathode cell 56 containing the cathode solution electrode 57 and the cathode electrode 58. The cathode cell contains a central circulating well 61, an impeller 46 acting against baffles 59 to provide agitation for the catholyte. The hydrogen ions are reduced to hydrogen gas 62 that is evolved from the catholyte. Reduction of the hydrogen ions may also be carried out by catalyst in the catholyte. The reduced catholyte 63 is recycled to the mixer 37 after a bleed stream 64 is removed for purification to maintain acceptable levels of impurities in the electrolyte. The electronic circuit is the same as described in FIG. 1.

Figure 4:
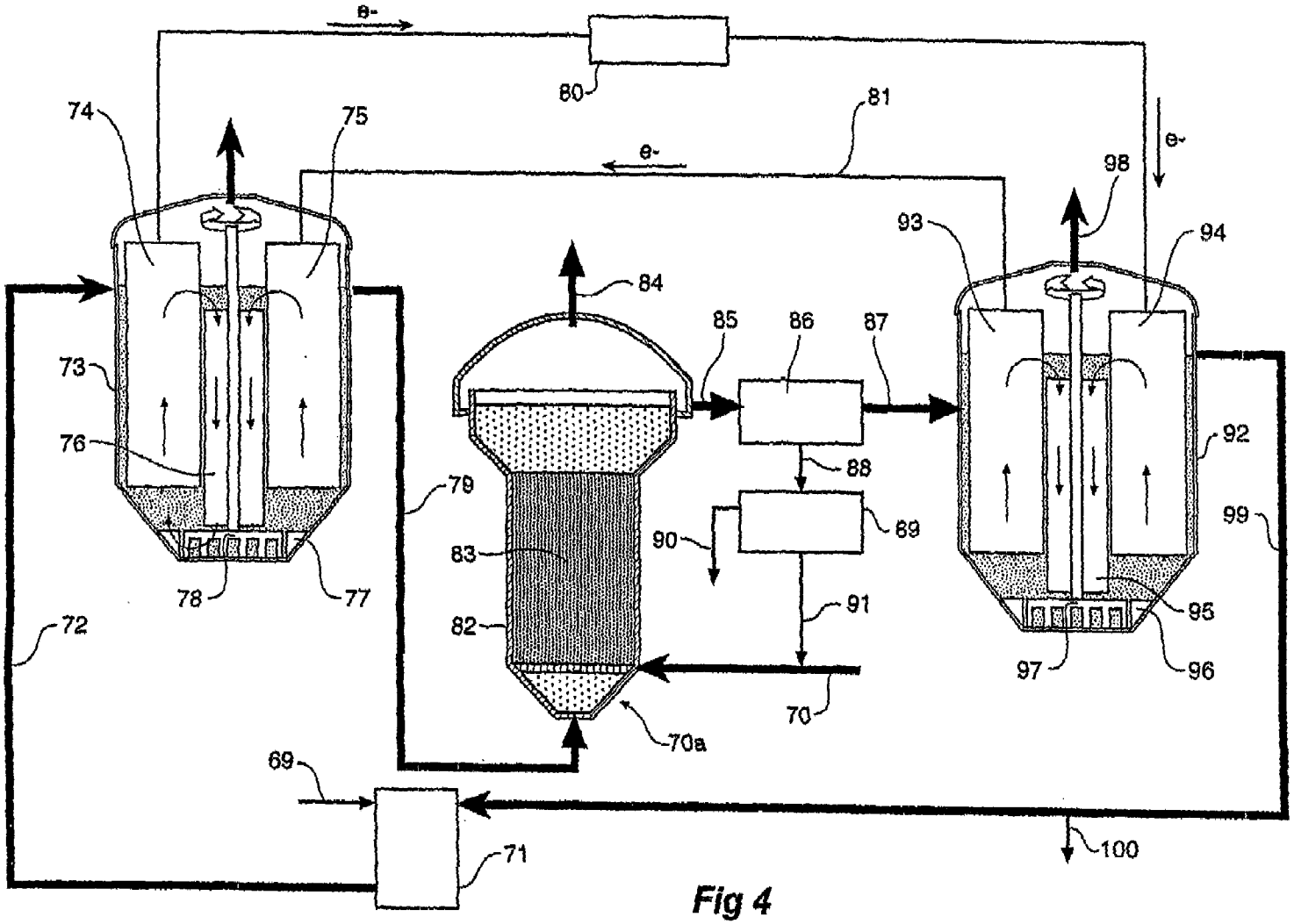
FIG. 4 shows oxidation of a fixed bed or slurry of coal in a separate tank according to the present invention.

FIG. 4 shows a process for the electrolytic oxidation of coal in a separate vessel according to an alternative embodiment of the invention.

Water, make-up electrolyte, reagents 69 and reacted catholyte 99 are mixed in the mixer 71 and the electrolyte 72 fed to the anode cell 73 containing the anode electrode 74 and the solution electrode 75. Agitation of the electrolyte is maintained by the circulating well 76 with the baffle 76 and impeller 77. Catalyst ions in the anolyte are oxidized at the anode electrode. The anode electrode is connected to the positive of the DC power source 80 while the anode solution electrode is connected to the cathode solution electrode 93 by the external conductor 81. The electrolyte 79 containing the oxidised catalyst ions is fed to the leach vessel 82 containing the fixed bed of coal 83 or coal slurry. Coal 70 is fed to the leach vessel 82. Microwave energy 70*a* may be introduced into the separate reaction vessel 82 to assist with the leaching of the coal. Catalysts in the electrolyte oxidize the carbon and water to form carbon dioxide and hydrogen ion. Hydrogen in the coal is converted to hydrogen ions. The carbon dioxide 84 is evolved from the electrolyte. Reacted coal slurry 85 is subject to gas-liquid-solid separation 86 with the slurry 88 delivered to coal separation 89 to produce waste product 90 and unreacted coal 91 that is recycled to the leach vessel 82. The clear electrolyte 87 containing the hydrogen ions is fed to the cathode cell 92 containing the cathode solution electrode 93 and the cathode electrode 94 connected to the negative of the DC power source 80. Agitation of the electrolyte is maintained by a centre circulating well 95, impeller 97 and baffles 96. Hydrogen ions are reduced to hydrogen gas at the cathode electrode. Some reduction may also be carried out by catalysts in the electrolyte. Hydrogen gas 98 is evolved from the catholyte before the catholyte 99 is transferred to the mixer 71. A bleed solution 100 is taken for purification to control the level of impurities in the electrolyte. The electronic circuit is the same as that described in FIG. 3.

Figure 5:
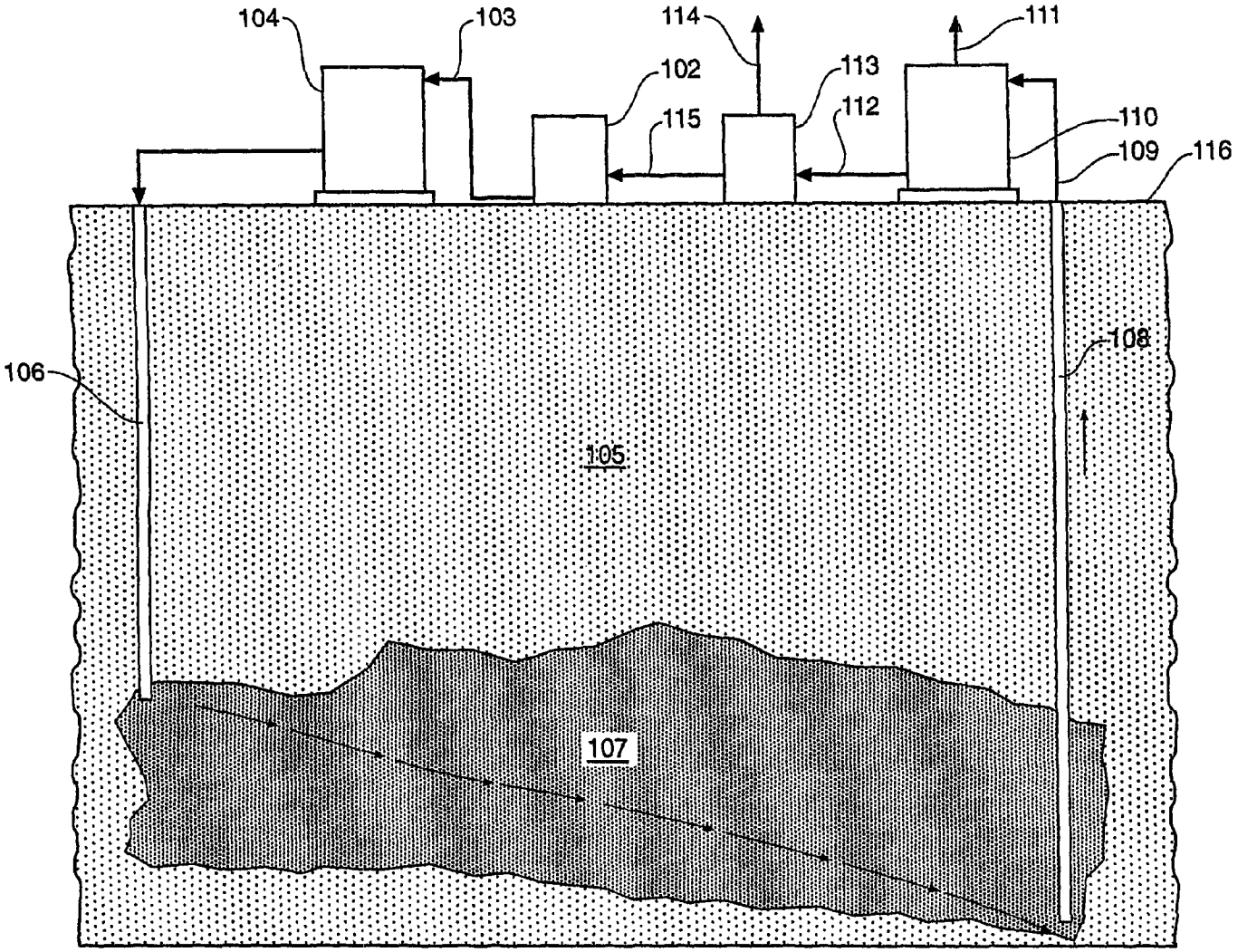
FIG. 5 shows solution mining of a deep deposit of coal according to the present invention.

FIG. 5 shows an electrolytic hydrogen process of the present invention as applied in situ to deep deposits of coal, oil shale or tar sands.

Oxidized electrolyte is stored in vessel 104 before it is delivered through waste rock 105 by pipe 106 to the broken coal deposit 107. The catalyst ions react with the carbon and water to form carbon dioxide and hydrogen ions. Hydrogen in the coal is converted to hydrogen ions. Deep hot coal deposits provide the heat required to maintain the reaction. Except for loses, carbon dioxide and the hydrogen ions are recovered and brought to the surface 116 with the spent electrolyte 109 through pipeline 108. Carbon dioxide 111 is separated in vessel 110. The electrolyte 112 is fed to the cathode cell 113 where hydrogen gas 114 is produced and separated. The spent electrolyte 115 is fed to the anode cell 102 where the catalyst is oxidized. The oxidized electrolyte 103 is transferred to storage 104.

Figure 6:
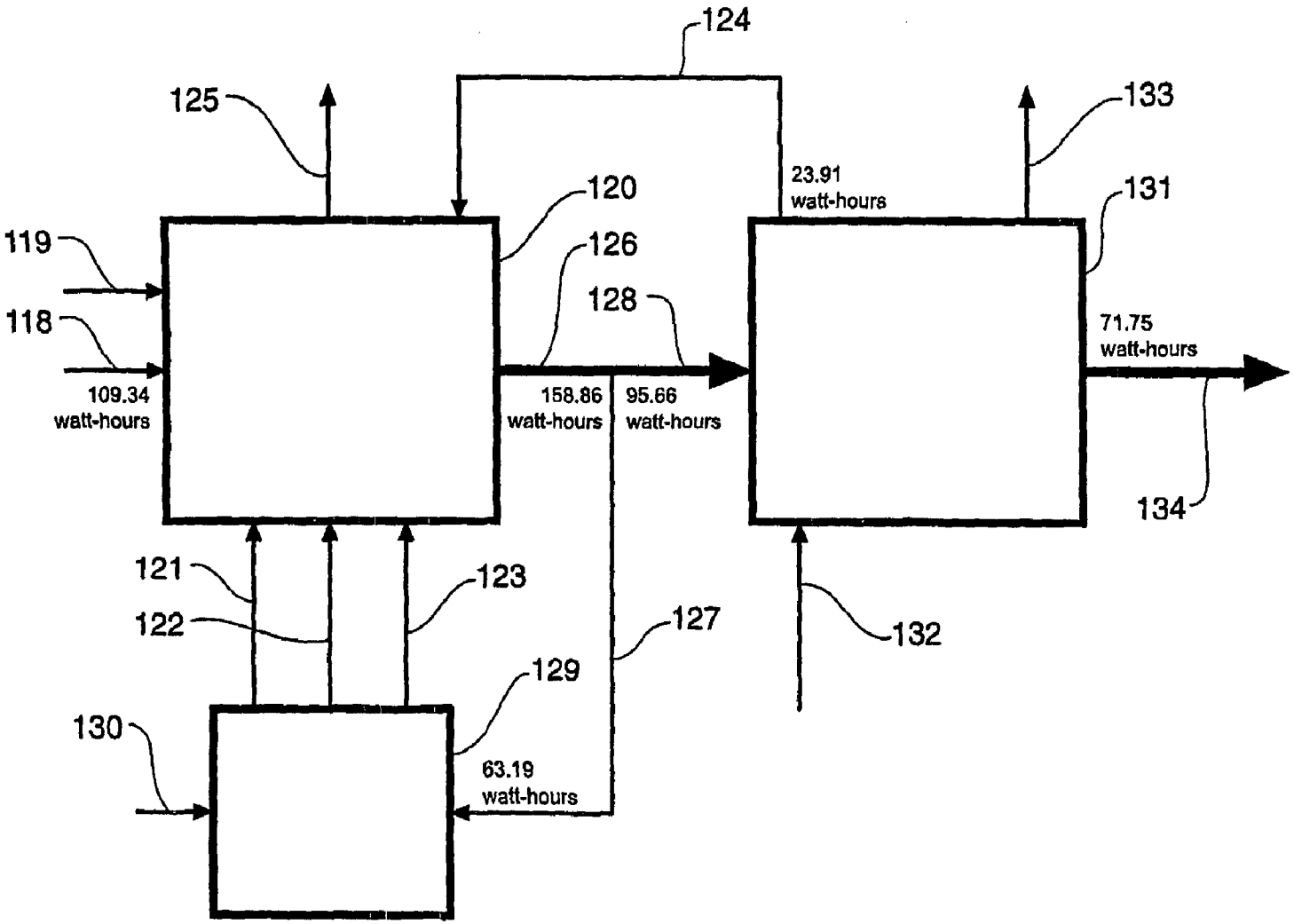
FIG. 6 shows the power balance in a coal to hydrogen-fuel cell power plant.

FIG. 6 shows a power balance in a coal to hydrogen-fuel cell power plant.

Coal 118 and water 119 are fed to the coal electrolysis plant 120. Inputs to coal electrolysis from a fuel cell unit 129 are DC power 121, heat 122, and water 123. Input to the fuel cell units for coal electrolysis are air 130 and hydrogen 127 from the coal electrolysis plant 120. Another input to coal electrolysis is heat from a main fuel cell or gas turbine power plant 131 if this plant is adjacent to the coal electrolysis plant. The output of the coal electrolysis plant 120 is carbon dioxide 125 and hydrogen gas 126. Part of the hydrogen produced 127 is fed to the fuel cell units 129 and the rest of the hydrogen 128 is fed to the main fuel cell or gas turbine power plant 131. Other input to the main power plant is air 132 and the outputs are water 133 and electric power 134. This power balance is based on a coal electrolysis voltage of 0.42 volts and a fuel cell efficiency of 75 percent.

FIG. 7 shows an embodiment of the present invention as applied to a 50 MW coal electrolytic plant.

Figure 7A:
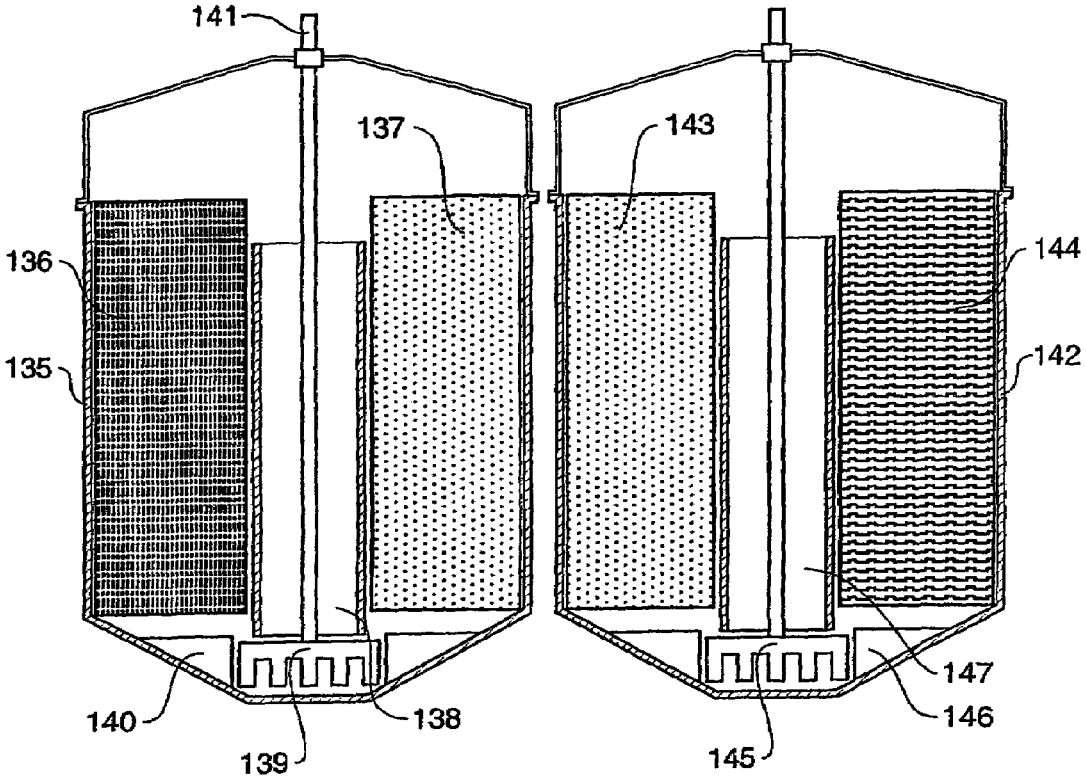
FIGS. 7A and 7B show a cross section and plan view of a large coal electrolytic cell train according to the present invention.
Figure 7B:
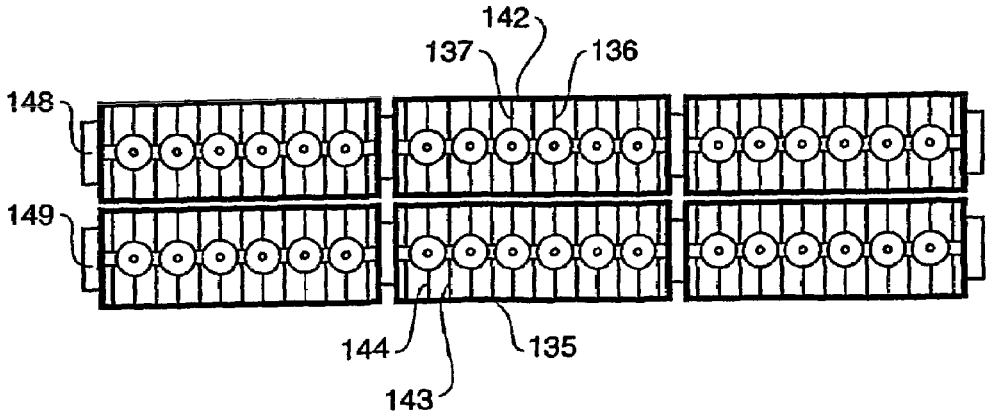

The cross section FIG. 7A shows the anode cell 135 containing the anode electrode 136 and the anode solution electrode 137. Agitation is maintained through a circulating centre well 138, impeller 139, baffles 140 and agitator shaft 141. The anode cell 135 may be insulated and provided with heating cavity. The adjacent cathode cell is similar to the anode cell structure. The cathode dimensions are shown the same as the anode cell dimensions but the dimensions of the cathode cell and electrodes may vary depending on the optimum current density determined after testing of the particular coal. The plan view FIG. 7B shows one train of cathode cells 148 and one train of anode cells 149.

Figure 8:
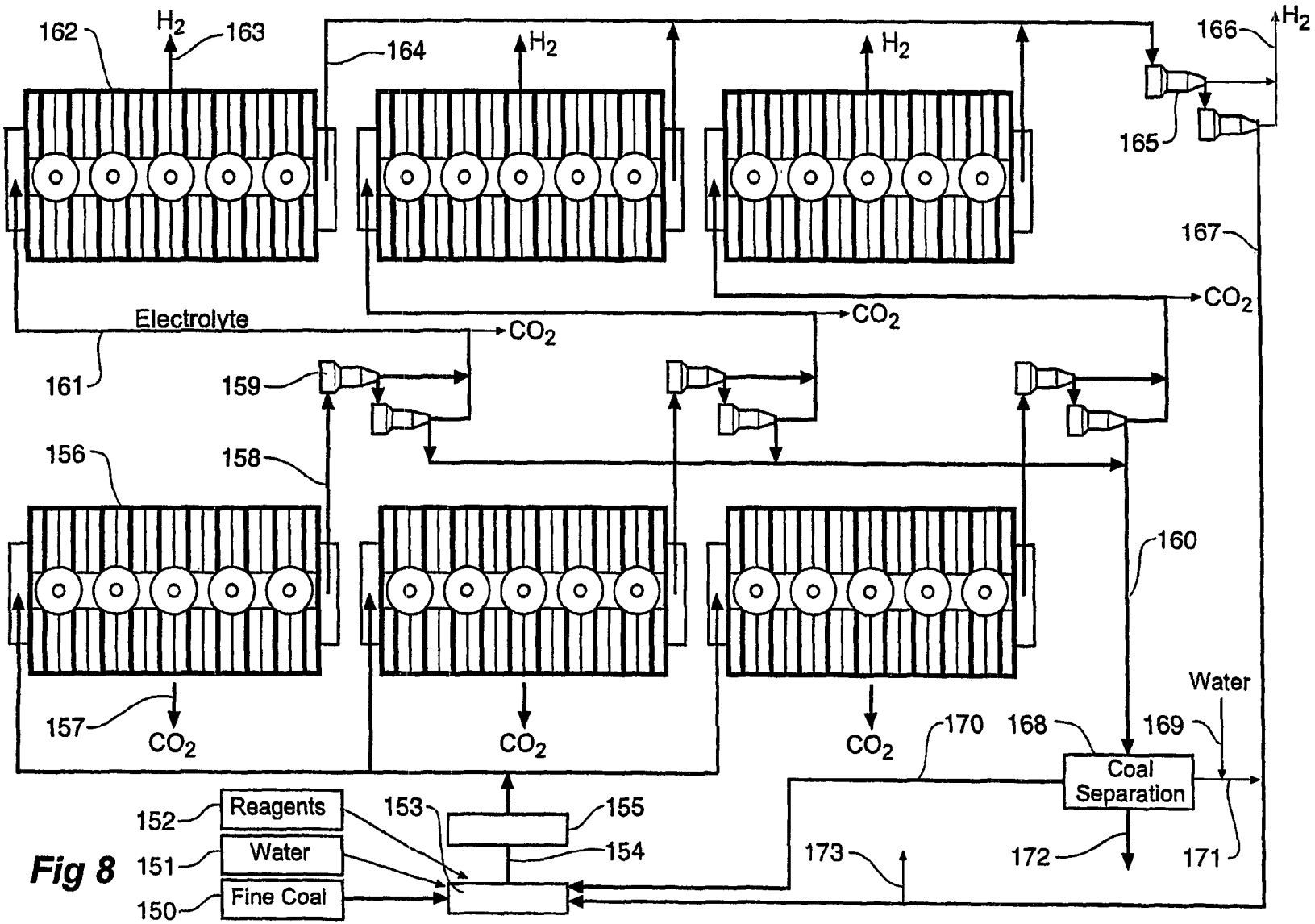
FIG. 8 shows a flow diagram of a large coal electrolytic cell train.

FIG. 8 shows a large electrolytic cell train for coal electrolysis according to an embodiment of the present invention.

The process described is a circulating coal slurry at the anode cell. Fine coal 150, water 151 and reagents 152 are fed into the mixer 153 along with reclaimed coal 170 and recycled electrolyte 167. The coal slurry 154 is heated in preheater 155 and then fed to the anode cell 156. Carbon dioxide 157 is produced at the anode cell and the reacted slurry 158 containing the hydrogen ions is fed to liquid vortex separators 159. Thick slurry 160 is dispatched to coal separation 168 while some more carbon dioxide is removed from the electrolyte 161 containing the hydrogen ions. This electrolyte 161 is fed to the cathode cells 162 where hydrogen 163 is produced. The spent electrolyte 164 is passed through liquid vortex separator 165 to remove more hydrogen 166 from the electrolyte before the electrolyte 167 is recycled to the mixer 153. Coal separation 168 may be carried out using froth flotation or gravity separation producing waste 172 and reclaimed coal 170. Wash water 169 is added to reclaim electrolyte from the waste and this lean electrolyte 171 joins the recycled electrolyte 167.

Figure 9:
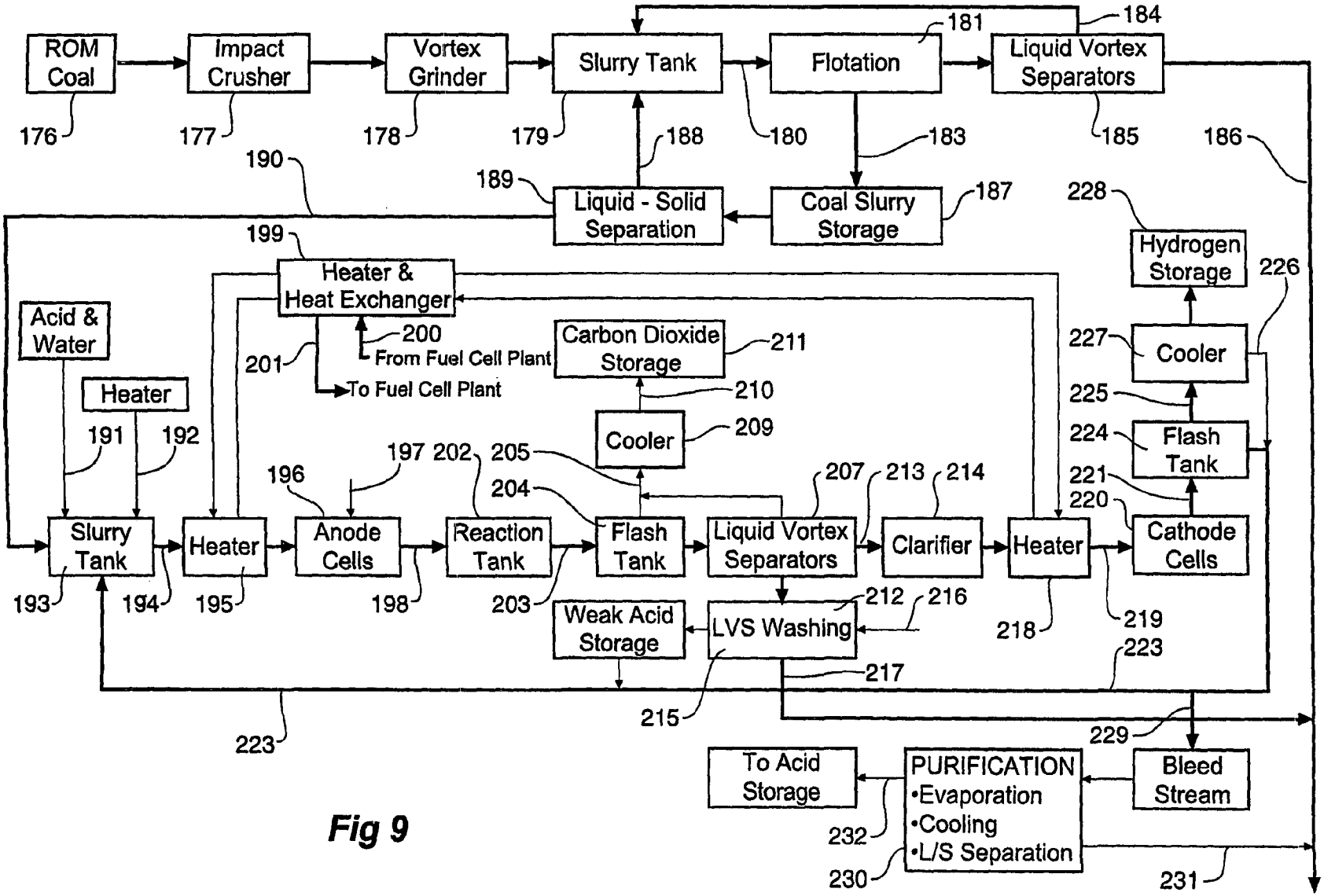
FIG. 9 is a flow diagram of a large commercial coal electrolytic plant.

FIG. 9 shows a commercial plant for the electrolysis of coal according to an embodiment of the present invention.

Coal preparation may consist of the run-of-ne coal 176 reduced in size by impact crusher 177 and ground fine using a vortex grinder 178. Upgrading may be washing to remove soluble matter like sodium chloride or removing insoluble matter by froth flotation 181 or by gravity separation. In this example, froth flotation is described. The fine coal is slurried in tank 179 with recycled liquids 184 and 188 and the slurry 180 is subjected to froth flotation where high purity coal 183 is delivered to coal slurry storage 187. Flotation tailings 182 are subjected to liquid vortex separation 185 with the waste 186 going to pond storage. Liquid is recycled to the slurry tank 179. Filtered fine coal 190 is fed to the slurry tank 193. If the run-of-mine coal 176 is of sufficient purity, the fine coal is fed directly to the feed slurry tank 193. Acid and water 191, catalysts 192 and recycled electrolyte 223 are added to the slurry tank 193 to produce coal slurry 194 that is heated in heater 195 where the heat is supplied from heat exchanger 199 using heat 200 from the fuel cell plant. The heated coal slurry 194 is fed to the anode cell 196 under pressure of up to 50 bars and temperature of up to 160 degrees Celsius with water 197 added into the anode cell 196. The reacted coal slurry 198 is kept in a reaction tank 202 to complete the oxidation of the coal before the reacted slurry 203 is fed into the flash tank 204 to bring the pressure to atmospheric. The hot flash tank will help in the removal of the carbon dioxide 205 that is cooled in cooler 209 before being stored in carbon dioxide storage 211. Liquid 206 from the flash tank is passed through liquid vortex separators 207 to remove more of the carbon dioxide 208 which is sent to the cooler 209. Thick slurry 212 from the liquid vortex separators is subjected to washing in liquid vortex separators 215 with wash water 216. The solids 217 are sent to coal recovery 186 or to waste. The weak add wash water joins the electrolyte stream 223. If required, electrolyte 213 from the liquid vortex separators 207 may be clarified in pressure filters 214 before it is heated in heater 218 and fed under pressure to the cathode cell 220. The electrolyte 221 containing the hydrogen gas is flashed in tank 224 where the hydrogen gas 225 is separated and cooled in cooler 227 before going to storage 228. Liquid 223 from the flash tank and 226 from the cooler are recycled to the coal slurry tank 193.

The electrolysis of coal to produce hydrogen can be carried out in a conventional diaphragm electrolytic cell but the reaction rates are too low that the process has no commercial value. This invention relates to a commercial process for the electrolytic conversion of coal or other solid hydrocarbons, liquid hydrocarbons and gas hydrocarbons and water at fast reaction rate to produce high purity hydrogen that is suitable for electric power generation and fuel for proton electrolytic membrane fuel cell powered transport vehicles. This invention was described using coal as the fuel because coal is the most abundant and widely dispersed of the fossil fuel with world reserves of several hundred years. The process of this invention is based on an electrolytic cell that operates without a diaphragm and delivers high reaction rates from small to very large capacity plants. The process contains innovative features such as operation under high pressure and moderate temperature and the simple removal of contained carbon dioxide gases from the electrolyte so that the hydrogen produced is not contaminated by carbon dioxide to make the hydrogen suitable fuel for proton electrolytic membrane fuel cells. The carbon dioxide produced in this process is of high purity suitable for industrial use or convenient for subsequent disposal process to prevent global warning.

There are large deposits of lignite and brown coal that contain moisture up to 66 percent that are ideal feed to the process of this invention because the process requires 3 tonnes of water for one tonne of carbon in the coal. There are also a range of coals from lignite to bituminous coal that have toxic or harmful impurities such as sulfur, mercury, arsenic, lead, cadmium and others that are not suitable as fuel for conventional commercial processes due to the interference of the impurities with process and the equipment or the harmful effect on the atmosphere such as add rain or dispersal of heavy metals in the atmosphere. The process of this invention is capable of processing these impure coals and separates these impurities in the process for safe disposal.

The claims defining the invention are as follows:

1. An electrolytic process that converts solid, liquid, or gas hydrocarbon compounds and water to carbon dioxide and hydrogen at high reaction rates comprising the step of using an electrolytic cell that operates without a diaphragm at high pressure and moderate temperature using catalysts in an electrolyte, wherein the electrolytic cell consists of an anode cell containing an anode electrode connected to a DC power source and an anode solution electrode connected by an external conductor to a cathode solution electrode and a cathode cell containing a cathode electrode connected to the DC power source and the cathode solution electrode and the electrolyte containing the catalysts and the hydrocarbon compounds are reacted with the water in the anode cell to produce the carbon dioxide and hydrogen ions and an electrolyte containing the hydrogen ions is transferred to the cathode cell and the hydrogen ions are reacted in the cathode cell to produce the hydrogen.

2. A process as in claim 1 wherein in the anode cell the anode electrode and the anode solution electrode are formed by a compound electrode comprising an inner anode electrode and an outer anode electrode and in the cathode cell the cathode electrode and the cathode solution electrode are formed by a compound electrode comprising an inner cathode electrode and an outer cathode electrode with the anode inner electrode connected to the cathode inner electrode by the external conductor and the outer anode electrode and the outer cathode electrode connected to the DC power source.

3. A process as in claim 1 wherein the hydrocarbon compounds are fine coal and the electrolyte is in the form of a slurry which is reacted with the water in the anode cell to produce the carbon dioxide and the hydrogen ions.

4. A process as in claim 3 wherein the slurry is preheated.

5. A process as in claim 3 wherein the slurry from the anode cell is retained in a reaction vessel to allow completion of reactions.

6. A process as in claim 3 wherein the slurry from the anode cell is subjected to liquid-solid-gas separation using a flash tank to reduce pressure and using liquid vortex separators or hydro-cyclones to separate the carbon dioxide, the electrolyte containing the hydrogen ions, and unreacted coal with insoluble waste.

7. A process as in claim 6 wherein the slurry is processed to extract the unreacted coal for recycle to the anode cell.

8. A process as in claim 6 wherein the electrolyte containing the hydrogen ions is preheated.

9. A process as in claim 1 wherein the catalysts are selected from iron, copper, cesium, vanadium, chlorine, bromine, boron or multi-valent ions.

10. A process as in claim 1 wherein the anode electrode and the cathode electrode shape and surface structure are designed to achieve intimate contact with the electrolyte and ions contained in the electrolyte.

11. A process as in claim 1 where material on the surface of the anode electrode and the cathode electrode offer low potential resistance or over-voltage.

12. A process as in claim 1 wherein active surfaces of the anode solution electrode and the cathode solution electrode are shielded by a non-conductor screen to prevent continuous contact of the catalysts in the electrolyte.

13. A process as in claim 1 further including adding modifiers to the electrolyte and on the surface of the anode and cathode electrodes so that the surface of the anode electrode and the cathode electrode are wetted by the electrolyte but are aerophobic or reject gas bubbles on the surface.

14. A process as in claim 1 wherein the temperature at the anode cell and the cathode cell is maintained at up to 160 degrees Celsius.

15. A process as in claim 1 wherein the pressure at the anode cell and at the cathode cell are maintained at up to 50 bars.

16. A process as in claim 1 where the water in the form of steam is added to the anode cell to provide heat as well as water for an anode reaction.

17. A process as in claim 1 wherein the anode cell and cathode cell are cubicle cells containing one set or a multitude of electrodes for large capacity plants or concentric cylindrical cells for low capacity plants.

18. A process as in claim 1 wherein the electrolyte is reduced in pressure at a flash tank to separate hydrogen gas from the electrolyte.

19. A process as in claim 18 wherein the electrolyte is further treated in a liquid vortex separator or hydro-cyclone to recover more hydrogen.

20. A process as in claim 1 wherein the electrolyte is recycled to a slurry feed tank of the anode cell.

21. A process as in claim 1 wherein a bleed stream is taken from the electrolyte.

22. A process as in claim 1 wherein only the electrolyte is fed into the anode cell and wherein the electrolyte from the anode cell is fed into a separate leaching vessel containing coal particles either in a fixed bed or a stirred slurry of coal particles and the electrolyte.

23. A process as in claim 22 wherein the slurry in the separate leaching vessel containing the coal particles is subject to microwave energy in the separate leaching vessel.

24. A process as in claim 22 wherein the slurry from the separate leaching vessel is subjected to gas-liquid solid separation.

25. A process as in claim 22 wherein the slurry is processed to reclaim the coal to be recycled to the separate leaching vessel.

26. A process as in claim 1 wherein the electrolyte containing the hydrogen ions is preheated and transferred to the cathode cell.

27. A process as in claim 1 wherein the hydrocarbon compounds are a hydrocarbon liquid.

28. A process as in claim 27 wherein the electrolyte further contains an emulsifying agent is added to break up the hydrocarbon liquid into very fine particles.

29. A process as in claim 1 wherein the hydrocarbon compounds are hydrocarbon gas.

* * * * *